US007986902B2

(12) United States Patent
Kim et al.

(10) Patent No.: US 7,986,902 B2
(45) Date of Patent: Jul. 26, 2011

(54) IMAGE FORMING APPARATUS AND REGULATING MEMBER AND CONTAINER

(75) Inventors: Tae Sung Kim, Saitama (JP); Kazuhiro Saito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 751 days.

(21) Appl. No.: 11/950,661

(22) Filed: Dec. 5, 2007

(65) Prior Publication Data

US 2008/0267669 A1 Oct. 30, 2008

(30) Foreign Application Priority Data

Apr. 27, 2007 (JP) ..... 2007-119234

(51) Int. Cl.
*G03G 21/18* (2006.01)
*G03G 15/08* (2006.01)

(52) U.S. Cl. ..... 399/114; 399/258

(58) Field of Classification Search ..... 399/258, 399/111, 114

See application file for complete search history.

(56) References Cited

U.S. PATENT DOCUMENTS

| | | | | |
|---|---|---|---|---|
| 7,272,340 | B2 * | 9/2007 | Song | 399/111 |
| 2007/0092270 | A1 * | 4/2007 | Inukai | 399/13 |
| 2007/0166070 | A1 * | 7/2007 | Sato | 399/90 |
| 2007/0189781 | A1 | 8/2007 | Katogi et al. | |

FOREIGN PATENT DOCUMENTS

| | | | |
|---|---|---|---|
| CN | 101021712 | A | 12/2006 |
| JP | 2005-091708 | A | 4/2005 |
| JP | 2006-71671 | A | 3/2006 |
| JP | 2006-171407 | A | 6/2006 |
| JP | 2006171407 | A * | 6/2006 |

OTHER PUBLICATIONS

English machine translation of JP2006171407.*
Notification of the First Office Action dated May 4, 2010 issued in Chinese Application No. 200710301299.4.

* cited by examiner

*Primary Examiner* — David M Gray
*Assistant Examiner* — Billy J Lactaoen
(74) *Attorney, Agent, or Firm* — Sughrue Mion, PLLC

(57) ABSTRACT

An image forming apparatus includes a container that contains a visualizing agent consumed with an operation of forming a visual image on a recording medium; a holding unit that detachably holds the container; and a regulating unit that is disposed in a packing member for packing the image forming apparatus and engages with a part of the container so as to prevent the container from departing from the holding unit.

15 Claims, 6 Drawing Sheets

IMAGE FORMING APPARATUS AND REGULATING MEMBER AND CONTAINER

CROSS-REFERENCE TO RELATED APPLICATIONS

This application is based on and claims priority under 35 USC 119 from Japanese Patent Application No. 2007-119234 filed on Apr. 27, 2007.

BACKGROUND

1. Technical Field

The present invention relates to an image forming apparatus, a regulating member and a container.

2. Related Art

An image forming apparatus, such as a laser printer, uses toner which is fine powder as a visualizing agent to form a visual image on a recording medium.

Such a toner is generally configured to be reserved in a container called toner cartridge, which is placed on a cartridge holding unit in a printer body, and to be supplied to a developing unit.

Meanwhile, usually, new printers just released in the market are separately packed with a toner cartridge that is unopened. However, in order to increase delivery efficiency in packing and conveniently use a printer soon after unpacking, various studies for packing the printer in a state where the toner cartridge is mounted thereon have been made.

In such a toner cartridge, a feed opening (such as a shutter member capable of opening and shutting) for supplying toner to a printer body is provided therein. Since the feed opening is loosened by vibration and impact during delivery, there have been problems of leakage of the toner and so on.

SUMMARY

According to an aspect of the invention, there is provided an image forming apparatus including: a container that contains a visualizing agent consumed with an operation of forming a visual image on a recording medium; a holding unit that detachably holds the container; and a regulating unit that is disposed in a packing member for packing the image forming apparatus and engages with a part of the container so as to prevent the container from departing from the holding unit.

BRIEF DESCRIPTION OF THE DRAWINGS

Exemplary embodiment(s) of the present invention will be described in detail based on the following figures, wherein:

FIG. 6A and FIG. 6B are explanatory views illustrating correlation between the toner cartridge and a regulating unit, wherein

Figure 1:
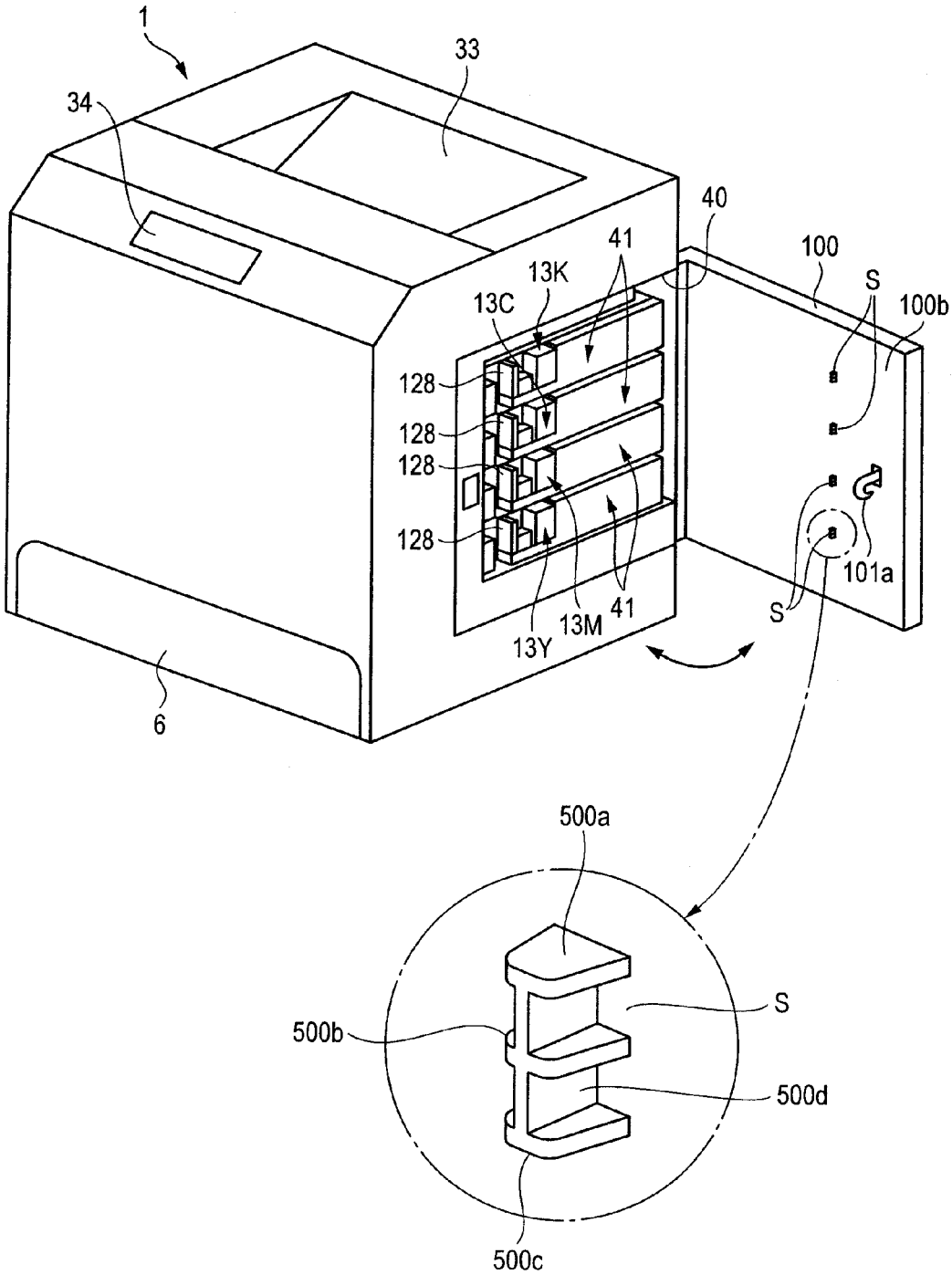
FIG. 1 is a perspective view illustrating an appearance of an image forming apparatus according to the invention.

1 denotes PRINTER BODY, 2 denotes IMAGE FORMING UNIT, 3 denotes CONVEYOR BELT UNIT, 4 denotes CONTROL UNIT, 5 denotes POWER SUPPLY CIRCUIT UNIT, 6 denotes PAPER FEEDING CASSETTE, 8 denotes PHOTOCONDUCTIVE DRUM, 9 denotes CHARGING ROLL, 10 denotes EXPOSURE DEVICE, 11 denotes DEVELOPING DEVICE, 12 denotes CLEANING DEVICE, 13 denotes TONER CARTRIDGE (CONTAINER), 14 denotes DEVELOPING ROLL, 15 denotes CLEANING BLADE, 16 denotes IMAGE PROCESSING DEVICE, 17 denotes PAPER CONVEYOR BELT, 18 denotes PAPER (RECORDING MEDIUM), 19 denotes DRIVING ROLL, 20 denotes DRIVEN ROLL, 22 denotes ABSORPTION ROLL, 23Y denotes TRANSFERRING ROLL, 28 denotes CONVEYING PATH, 29 denotes FIXING DEVICE, 30 denotes HEATING ROLL, 31 denotes PRESSURIZING BELT, 32 denotes DISCHARGING ROLL, 33 denotes DISCHARGING TRAY, 34 denotes MANIPULATION PANEL, 40 denotes OPENING, 41 denotes CARTRIDGE HOLDER (HOLDING UNIT), 100 denotes OPENABLE COVER (COVER MEMBER), 100*b* denotes FACE, S denotes REGULATING UNIT, 500*a*, 500*b*, 500*c* and 500*d* denote RIB, 101*a* denotes HOOK, 102 denotes SUPPLY TONER CONTAINING UNIT, 103 denotes RECOVERY TONER CONTAINING UNIT, 104 denotes SUPPLY TONER CONTAINER, 106 denotes RECOVERY TONER CONTAINER, 111 denotes TONER SUPPLY PATH, 113 denotes SHUTTER MEMBER, 123 denotes WASTE TONER RECOVERY HOLE, 128 denotes HANDLE MEMBER (MANIPULATING MEMBER), 156 denotes DRIVING GEAR, 178 denotes ENGAGING PORTION FOR REGULATING, 178*c* denotes GROOVE, 179 denotes PROTRUSION, 190 denotes RECOVERY TONER CONVEYING MEMBER, 190 denotes WASTE TONER PATH, 191 denotes GEAR, 194 denotes TONER CONVEYING MEMBER, 195 denotes TONER INJECTION HOLE, 250 denotes COMMUNICATION TAG, and 251 denotes CONNECTION TERMINAL.

DETAILED DESCRIPTION

Hereinafter, an exemplary embodiment of the invention will be described in detail with reference to the drawings. In the case where common elements exist in the drawings, those elements will be referenced by the same reference numerals and signs, and detailed description thereof will be omitted. Further, the description in the following embodiment is the best mode for carrying out the invention, and thus the invention is not limited to the embodiment.

Figure 2:
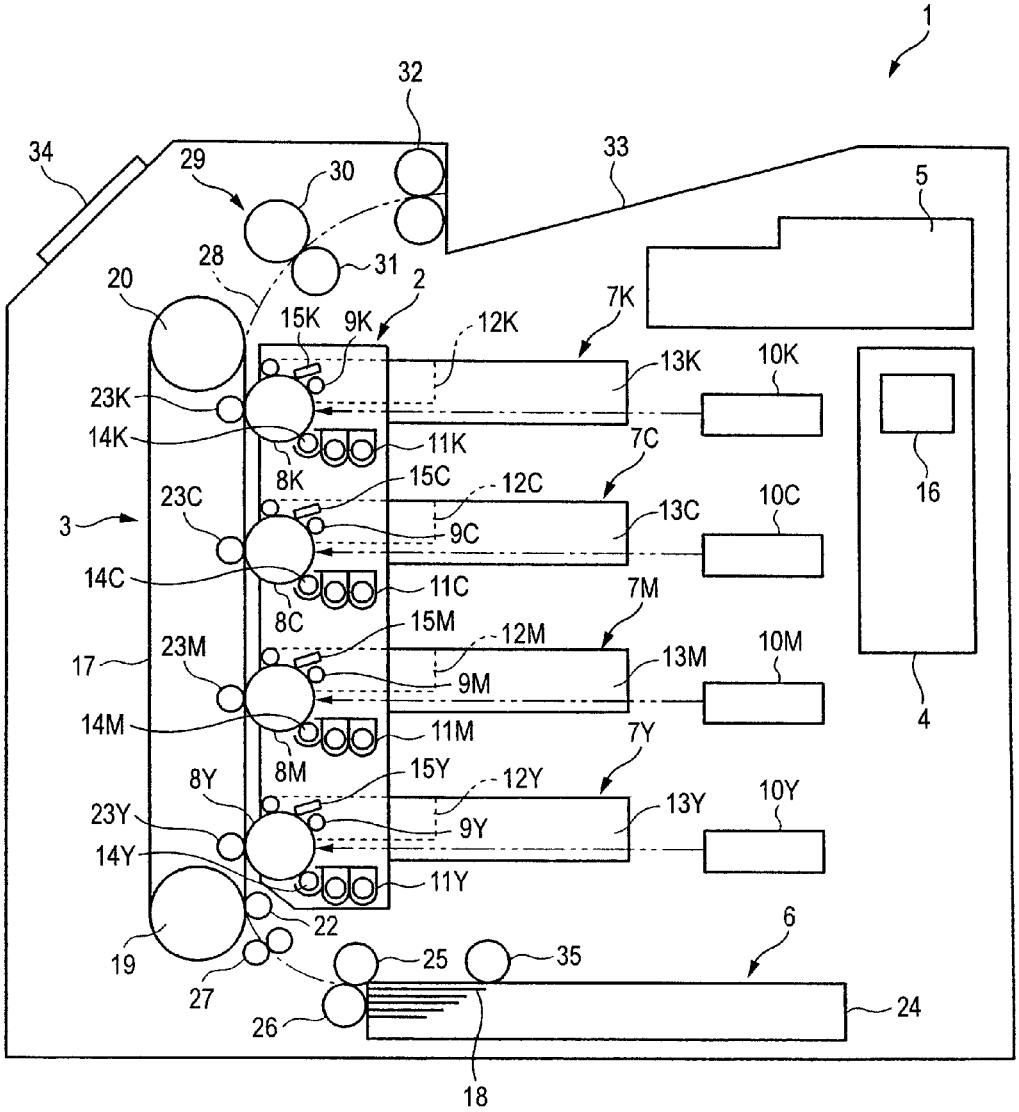
FIG. 2 is a diagram illustrating a configuration of the image forming apparatus.
Figure 3:
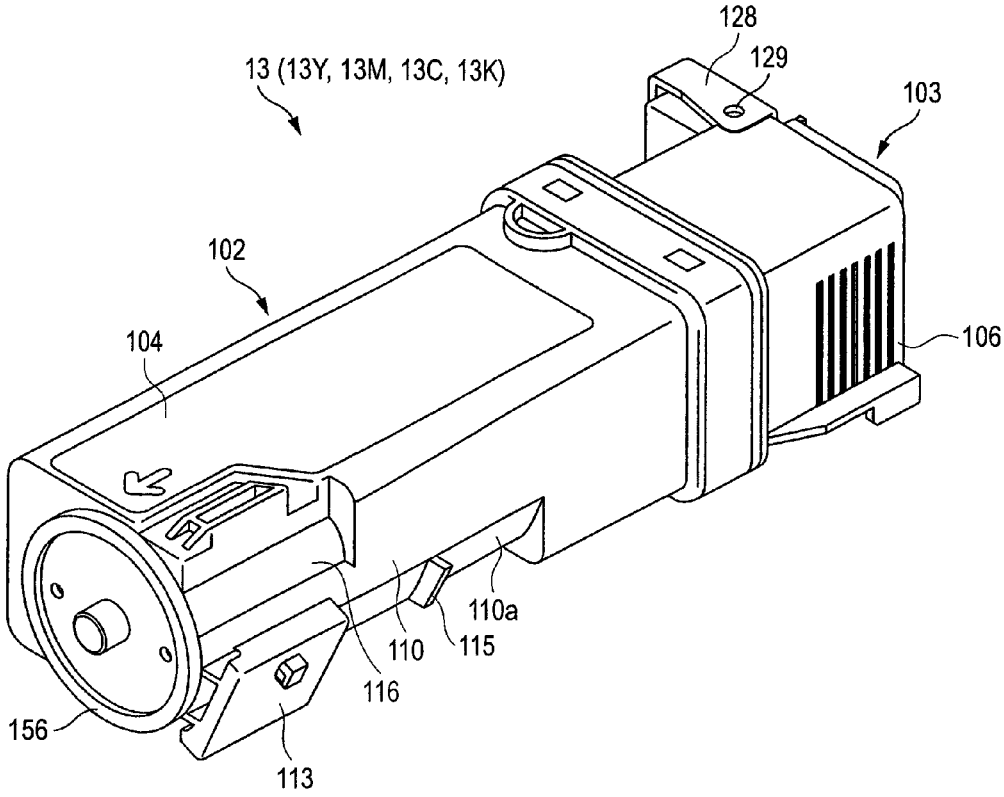
FIG. 3 is a perspective view illustrating an appearance of a toner cartridge.
Figure 4:
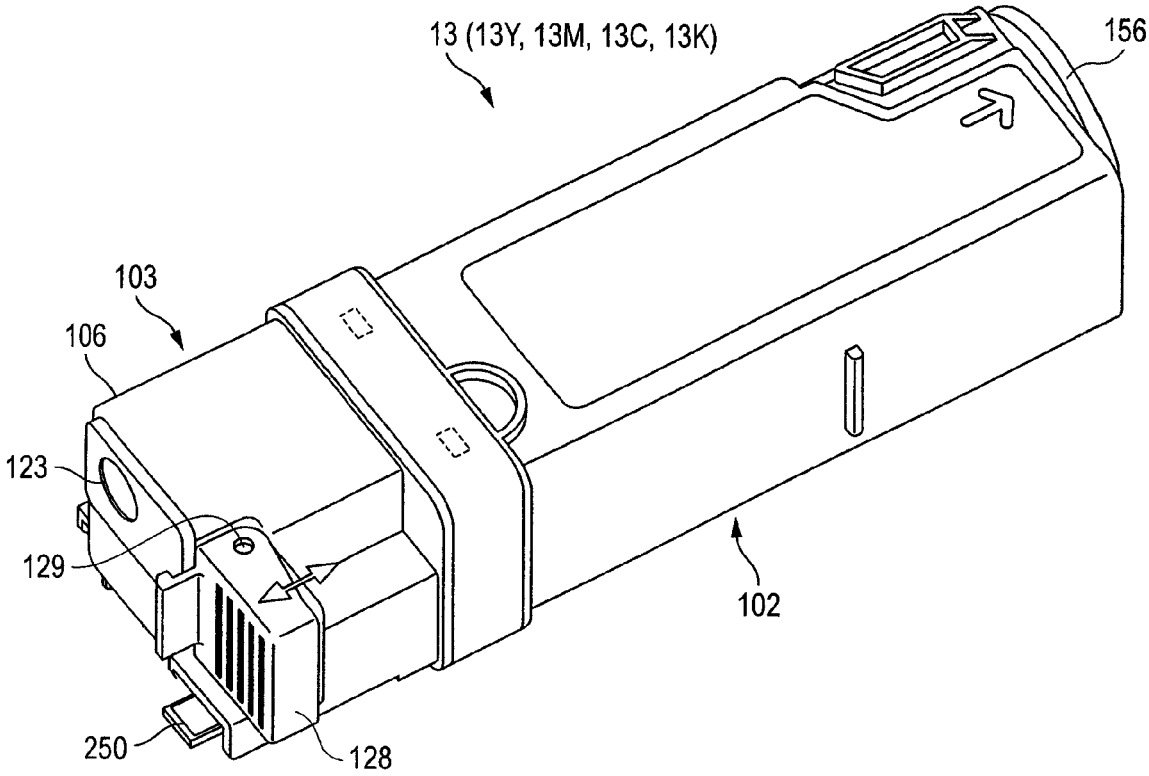
FIG. 4 is a perspective view illustrating an appearance of a toner cartridge.
Figure 5:
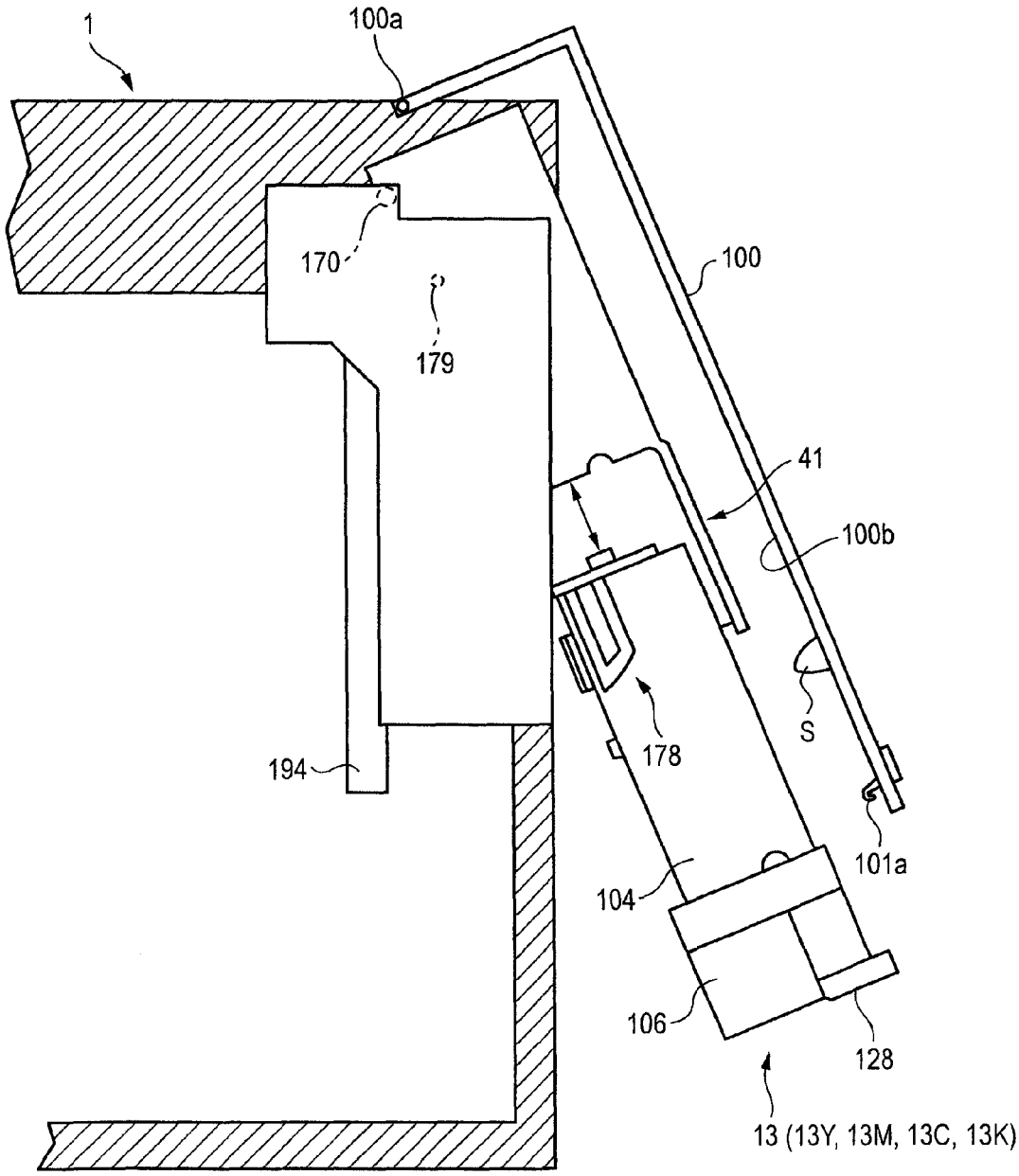
FIG. 5 is an explanatory view illustrating correlation between the toner cartridge and a cartridge holder.
Figure 6B:
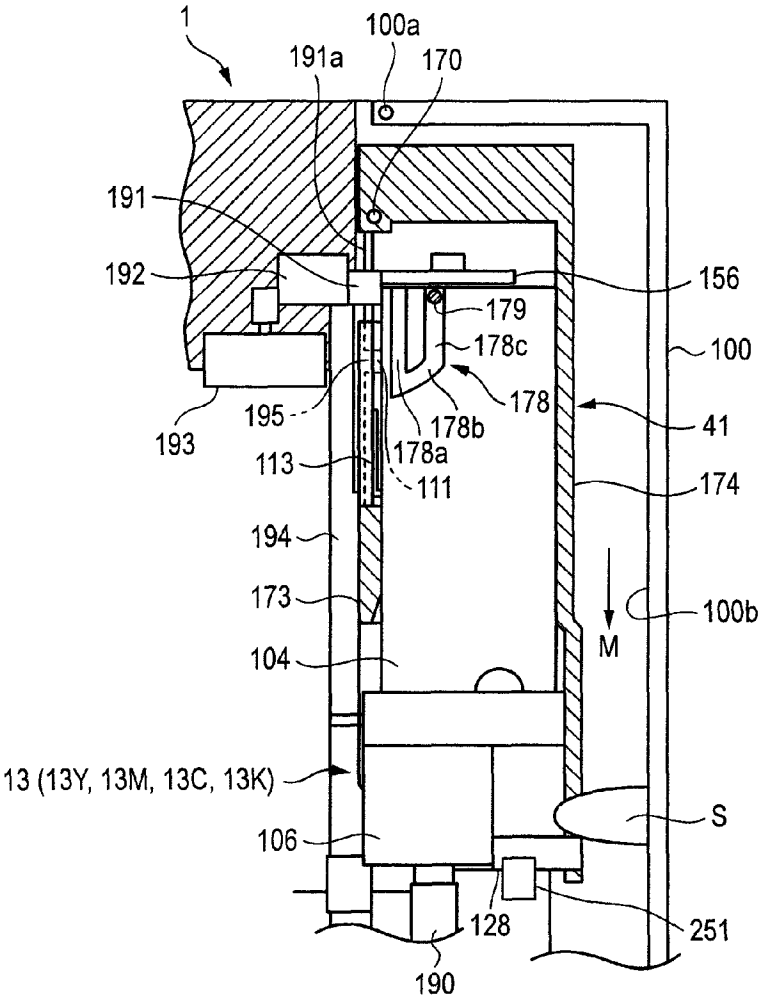
Figure 6A:
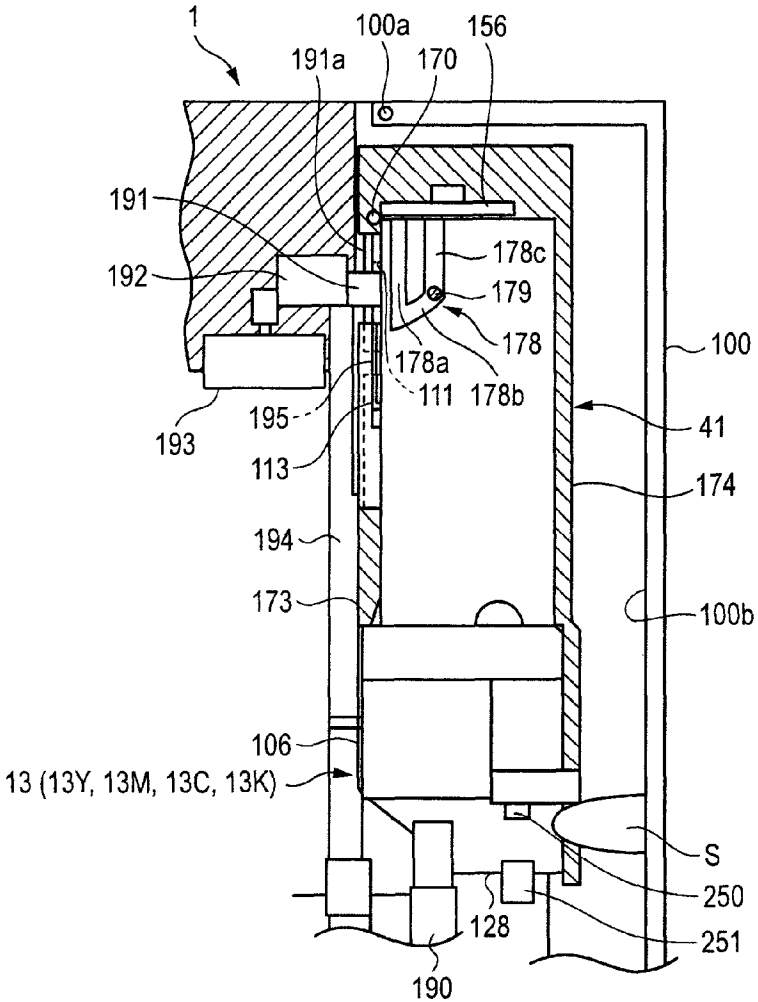

FIG. 1 is a perspective view illustrating an appearance of an image forming apparatus according to the invention. FIG. 2 is a diagram illustrating a configuration of the image forming apparatus. FIG. 3 is a perspective view illustrating an appearance of a toner cartridge. FIG. 4 is a perspective view illustrating an appearance of a toner cartridge. FIG. 5 is an explanatory view illustrating correlation between the toner cartridge and a cartridge holder. FIG. 6A and FIG. 6B are explanatory views illustrating correlation between the toner cartridge and a regulating unit.

First, a schematic configuration of the image forming apparatus according to the invention will be described with reference to FIGS. 1 and 2.

FIGS. 1 and 2 show a tandem type full-color printer 1 which is an example of the image forming apparatus. The full-color printer is configured to perform a print operation on the basis of image data sent from, for example, a personal computer, a scanner, and the like. Further, the image forming apparatus may be configured as a copier and a facsimile including a scanner or a multi function printer including all functions as just described.

In FIG. 2, an image forming unit 2 is disposed near the center inside the tandem type full-color printer body 1 in up and down directions. Further, inside the full-color printer body 1, a conveyor belt unit 3 that can convey the transferring material in a state where the material is adhered to the belt is disposed on one side (left side in FIG. 2) of the image forming unit 2. The toner image having plural colors is formed and then transferred onto the transferring material by the image forming unit 2. A control unit 4 including a control circuit and the like is disposed on the other side (right side in FIG. 2) of the image forming unit 2. A power supply circuit unit 5 including a high-pressure power supply circuit is disposed on upper side of the image forming unit 2 in a diagonal direction thereof.

Further, on the bottom section inside the full-color printer body 1, a paper feeding cassette 6 that receives a paper 18 serving as a recording medium to form an image thereon and feeds the paper is disposed.

In order from the bottom, the image forming unit 2 includes four image forming sections 7Y, 7M, 7C, and 7K to form toner images having respective colors of yellow (Y), magenta (M), cyan (C), and black (K), respectively. The four image forming sections 7Y, 7M, 7C, and 7K are arranged in series with a predetermined space in the up and down directions.

Configurations of the four image forming sections 7Y, 7M, 7C, and 7K are the same, other than a color of an image to form. Each image forming section includes a photoconductive drum 8 that rotates at a predetermined revolution speed, a primary charging roll 9 that uniformly charges the surface of the photoconductive drum 8, an exposure device 10 that exposes the images corresponding to the colors on the surface of the photoconductive drum 8 to form electrostatic latent images, a developing device 11 that performs development by using the toner of the color corresponding to the electrostatic latent image formed on the photoconductive drum 8, a cleaning device 12 that performs cleaning of the residual toner remaining on the photoconductive drum 8, and a toner cartridge (container) 13 that supplies the toner (a visualizing agent) to the developing device 11.

As shown in FIG. 1, an openable cover (cover member) 100 that is disposed on a side face of the printer body 1 is opened by pulling a grip (not shown in the drawings) disposed on the openable cover 100 so as to release the locking state of the hook 101*a*, and toner cartridges 13Y, 13M, 13C, and 13K of the colors of yellow (Y), magenta (M), cyan (C), and black (K) are loaded in a cartridge holder (a holding unit) 41 that is disposed on an opening 40 exposed to the side face of the printer body 1.

The toner cartridges 13Y, 13M, 13C, and 13K have the same configuration in the base structure thereof except that the colors of the toner contained therein are different.

Further, as shown in FIG. 5, a cartridge holder 41 is configured to be rotated about a rotation axis centered on a supporting point 170 from the printer body 1, and the toner cartridges 13Y, 13M, 13C, and 13K are detachable in a state where the cartridge holder 41 sufficiently turns (state of FIG. 5).

Further, the cartridge holder 41 in which the toner cartridges 13Y, 13M, 13C, and 13K is loaded is rotated from the state shown in FIG. 5 towards the printer body 1 side about a rotation axis centered on a supporting point 170. Then, the toner cartridges 13Y, 13M, 13C, and 13K is fixed on the printer body 1 by manipulating a handle member (a manipulating member) 128 that is disposed on the toner cartridges 13Y, 13M, 13C, and 13K, and the cartridges can supply the contained toner to the printer body 1.

FIGS. 3 and 4 are perspective views illustrating the toner cartridge serving as a container according to the embodiment as viewed from different directions, respectively.

In FIGS. 3 and 4, the reference numeral 13 represents a toner cartridge, and the toner cartridge 13 is configured to be formed in a substantially rectangular solid shape that is thin and long. The toner cartridge 13 includes a supply toner container 104 that has a supply toner containing unit 102 for containing supply developer formed of new toner or new toner and carrier and a recovery toner container 106 that is connected to an end portion in a longitudinal direction of the supply toner container 104 and that has a recovery toner containing unit 103 that contains recovery toner or recovery developer recovered from developing device 11 or recovery toner removed by a cleaning device 12.

Further, according to the embodiment, the recovery toner removed by the cleaning device 12 is contained in a recovery toner containing unit 103.

In addition, in the recovery toner container 106 as shown in FIGS. 3 and 4, a handle member (manipulating member) 128 to load and fix the toner cartridge 13 on a predetermined position is mounted as a rotatable member centered on a supporting point 129. Inside the handle member 128, a spring portion that gives elastic force to the handle member 128 (not shown in the drawings). Although not especially limited, the handle member 128 may be made of rubber or plastic that has elasticity.

Further, as shown in FIG. 1, a regulating unit (stopper) S that regulates the toner cartridges 13Y, 13M, 13C, and 13K so as not to depart from the cartridge holder 41 by engaging with a part of the toner cartridges 13Y, 13M, 13C, and 13K is disposed on the face 100*b* facing to the toner cartridges 13Y, 13M, 13C, and 13K of the openable cover 100.

More specifically, as shown in an enlarged view of the regulating unit S in FIG. 1, gaps among three ribs 500*a*, 500*b*, and 500*c* of which section has a substantial semi-cylindrical shape are connected to each other by a rib 500*d* orthogonal to the ribs. However, the shape of the regulating units S is not limited to this, and for example, the entire regulating units may be formed as a protrusion and the like having the semi-cylindrical shape and the like. In addition, the front end thereof may be formed in a wedge shape that has a more acute angle.

The regulating unit S can be integrally formed of resin such as plastic constituting the openable cover 100, but the invention is not limited to this, and thus a regulating member that is separately provided on the face 100*b* of the openable cover 100 may be mounted by adhesion, welding and the like.

This regulating units S are disposed on a position in contact with the handle member 128 of the toner cartridges 13Y, 13M, 13C, and 13K maintained in the cartridge holder 41 as described later.

In this case, the toner cartridges 13 (13Y, 13M, 13C, and 13K) are loaded on the cartridge holder 41 of the printer body 1 side in a state where the openable cover 100 of the printer body 1 is opened as shown in FIG. 5. The cartridge holder 41 is provided as a rotatable member about the rotational axis centered on the supporting point 170 in the printer body 1. A front end portion of the cartridge holder 41 is opened.

The toner cartridges 13 are loaded by rotating the cartridges to the printer body 1 side about the rotation axis centered on the supporting point 170 in a state where the cartridges are pushed and inserted to the inside of the cartridge holder 41. Then, the cartridge 13 is slid by gripping the handle member 128 by a hand. Thus, as shown in FIG. 6B, the cartridge 13 is stopped when the handle member 128 is locked into a locking portion, which is not shown in the drawings, of the printer body 1 side. In this condition, a shutter member 113 of the toner cartridge 13 is opened, a toner feed opening 111 of the toner cartridge 13 is connected with a toner injection hole 195 of the printer body 1 side, the front end of a recovery toner conveying member 190 of the printer body 1 side is connected to a waste toner recovery hole 123 of the toner cartridge 13, and a driving gear 156 of the toner cartridge 13 meshes with a gear 191 of the printer body 1 side.

A stirring and conveying member (not shown in the drawings) that is provided in the toner cartridge 13 and that stirs and conveys the contained toner to the toner feed opening 111 is connected to the driving gear 156.

Further, a communication tag (communication unit) 250 provided in the toner cartridge 13 is connected to a connection terminal 251 of the printer body 1 side by a sliding operation. Information relating to the toner cartridge 13 such as ID for judging that the toner cartridge is original or not, a date of manufacture, a location of manufacture, and the like is noted in the communication tag 250, and the information is configured to be transmitted to the printer body 1 via the connection terminal 251.

Further, in FIG. 6A, the reference numeral 100*a* represents a supporting point of the openable cover 100.

On the other hand, when the openable cover 100 is closed while the sliding operation is not performed (FIG. 6A), end portions of the regulating units S provided on the face 100*b* fading to the toner cartridges 13Y, 13M, 13C, and 13K of the openable cover 100 become in contact with end portions of the handle members 128 of the toner cartridges 13 (13Y, 13M, 13C, 13K). With such a configuration, it is possible to prevent the toner cartridges 13 (13Y, 13M, 13C, and 13K) from departing from the cartridge holder 41.

In this condition, the shutter member 113 of the toner cartridge 13 is not opened and is not communicated with the toner injection hole 195 of the printer body 1 side. Further, a driving gear 156 of the toner cartridge 13 does not mesh with a gear 191 of the printer body 1 side. In addition, the communication tag 250 is not connected to the connection terminal 251. With such a configuration, it is possible to obviate leakage of the visualizing agent caused by false drive of the stirring and conveying member in the course of transportation, and it is possible to obviate false detection of the container in the course of transportation.

As shown in FIG. 6A, the printer body 1 is transported by packing in a state where the toner cartridges 13 (13Y, 13M, 13C, and 13K) are kept in the cartridge holder 41. However, as described above, even when shock and vibration is received in the course of transportation, it is possible to prevent the toner cartridges 13 (13Y, 13M, 13C, and 13K) from departing from the cartridge holder 41 by an operation of the regulating units S. Thus, it is possible to obviate leakage of the toner from the vicinity of the shutter member 113.

Particularly, according to the embodiment, the regulating units S are integrally provided on the face 100*b* of the openable cover 100. Thus, there is no need to separately load a vibration prevention member of the toner cartridges 13 and the like in the same manner as the known configuration, and it is possible to suppress the leakage of the toner only by performing a work of closing the openable cover 100. As a result, there is an advantage that it is possible to increase work efficiency and decrease costs.

After the printer 1 is transported and unpacked, the toner cartridges 13 (13Y, 13M, 13C, and 13K) is moved in a direction indicated by an arrow M (see FIG. 6B) by manipulating the handle members 128 in a state where the openable cover 100 is opened. Then, a waste toner path 190 that is formed in a cylindrical shape of the printer body 1 side is connected to a waste toner recovery hole 123 (see FIG. 4) that is disposed on an end of the toner cartridge 13.

In addition, the toner cartridge 13 is configured so that the driving gear 156 of the corresponding toner cartridge 13 side mutually meshes with a driving force transmitting gear 191 of the printer body 1 side and rotation driving force of a driving motor 193 provided on the printer body 1 side is transmitted to the driving gear 156 of the toner cartridge 13 via an intermediate gear 192.

In addition, when the toner cartridge 13 is moved to the position shown in FIG. 6B, the shutter member 113 that closes the toner feed opening 111 disposed on the side face of the corresponding toner cartridge 13 is opened, the toner cartridge 13 is communicated with the toner injection hole 195 of the toner conveying member 194 that is disposed on the printer body 1 side, and the supply toner that is contained in the supply toner containing unit 102 of the toner cartridge 13 is supplied to the developing device 11 of the printer body 1 side.

Subsequently, when the openable cover 100 is closed, the end portions of the regulating units S become in contact with rear end portions of the handle members 128 of the toner cartridges 13 (13Y, 13M, 13C, 13K), respectively.

Due to the movement of the regulating units S, it is possible to obviate backward movement of the handle members 128 caused by vibration and the like that occur in the process of operating the full-color printer 1. As a result, it is possible to more stably use the full-color printer 1.

The other parts of the full-color printer 1 will be described with reference to FIG. 2.

The developing device 11 is configured so as to supply developer having one component or two components contained therein to a developing roll 14 while stirring the developer, to convey the developer to the developing area facing to the photoconductive drum 8 while regulating a layer thickness of the developer supplied to the corresponding developing roll 14, and to develop an electrostatic latent image formed on the surface of the corresponding photoconductive drum 8 by using a toner of a predetermined color.

In addition, the cleaning device 12 is configured so as to remove transfer residual toner remaining on the surface of the photoconductive drum 8 by using a cleaning blade 15 and to convey and contain the removed transfer residual toner into the cleaning device 12.

In addition, the control unit 4 is disposed on inside of the full-color printer body 1, and for example, the image processing device 16 that performs a predetermined image process on image data is disposed on the control unit 4. The image data of colors of yellow (Y), magenta (M), cyan (C), and black (K) is outputted from the image processing device 16 to the exposure device 10. Four laser beams LB that are emitted from the exposure device 10 in accordance the image data perform scan exposure on the photoconductive drums 8Y, 8M, 8C, and 8K, respectively, and the electrostatic latent images are formed. The electrostatic latent images formed on the photoconductive drums 8Y, 8M, 8C, and 8K are developed into toner images having colors of yellow (Y), magenta (M), cyan (C), and black (K) by the developing devices 11Y, 11M, 11C, and 11K.

In addition, the conveyor belt unit 3 serving as a loop-shaped belt includes a paper conveyor belt 17 that circularly moves. The paper conveyor belt 17 is configured to convey a paper 18 in a state where the toner images having the colors of yellow (Y), magenta (M), cyan (C), and black (K) formed by the image forming sections 7Y, 7M, 7C, and 7K are electrostatically transferred into the paper 18 serving as transferring material.

The paper conveyor belt 17 is extended with a predetermined tension between a driving roll 19 and a driven roll 20 as tension rolls arranged in the up and down directions. The paper conveyor belt 17 is configured to circularly move in a clockwise direction at a predetermined speed by the driving roll 19 that is rotated by the driving motor not shown in the drawings.

In addition, an absorption roll 22 for electrostatically adhering the paper 18 to the surface of the paper conveyor belt 17 is disposed so as to come into contact with the surface of the driving roll 19 via the paper conveyor belt 17. Likewise, for example, the charging rolls 9 of the image forming sections 7Y, 7M, 7C, and 7K, the absorption roll 22 is configured to be covered with conductive rubber on the surface of a metallic core, and a predetermined bias voltage for absorption is applied to the metallic core. The absorption roll 22 is configured to adhere the paper 18 sent from the paper feeding cassette 6 to the surface of the paper conveyor belt 17 by electrostatically charging the paper 18. In addition, the absorption roll 22 may not be provided necessarily.

The toner images having the colors of yellow (Y), magenta (M), cyan (C) and black (K) formed on the photoconductive drums 8Y, 8M, 8C, and 8K by the image forming sections 7Y, 7M, 7C, and 7K are simultaneously transferred onto the paper 18 that is conveyed in a state of adhering to the surface of the paper conveyor belt 17, in a state where the toner images are superposed with each other by transferring rolls 23Y, 23M, 23C, and 23K. In addition, the transferring rolls 23Y, 23M, 23C, and 23K are integrally mounted on the conveyor belt unit 3.

The paper 18 is fed from the paper feeding cassette 6 that is disposed on the bottom of the printer body 1.

After the paper 18 to which the toner images having the colors of yellow (Y), magenta (M), cyan (C), and black (K) are simultaneously transferred is separated from the paper conveyor belt 17 by rigidity (elastic force) of the paper 18 itself, the paper 18 is conveyed to a fixing device 29 along a conveying path 28. By applying heat and pressure to the paper 18 in the fixing device 29, the toner images are fixed on the paper 18.

The paper conveyor belt 17 and the fixing device 29 are arranged to be close to each other, and the paper 18 that is separated from the paper conveyor belt 17 is conveyed to the fixing device 29 by the paper conveyor belt 17. The fixing device 29 rotates in a state where a heating roll 30 and a pressurizing belt 31 are pressed to be in contact with each other and performs the heat and pressure fixing process by allowing the paper 18 to pass a nip portion that is formed between the heating roll 30 and the pressurizing belt 31.

Then, the paper 18 on which the toner image having the colors is fixed is discharged by a discharging roll 32 in a state where a print surface faces downwards on a discharging tray 33 disposed on the upper portion of the full-color printer body 1, and thereby a printer operation is finished.

In addition, in the full-color printer, it is possible to print an image of a desired color such as monochromatic color without limitation to the full colored image, and the toner image is formed by the image forming sections 7Y, 7M, 7C, and 7K of all or some among yellow (Y), magenta (M), cyan (C), and black (K) in accordance with colors of a printing image.

In addition, in FIGS. 1 and 2, the reference numeral 34 represents a manipulation panel including a display unit such as a liquid crystal panel mounted on the front side of the printer body 1. The manipulation panel 34 is configured to perform a required manipulation such as random specification of a paper size or printer condition display.

As described above, the invention has been described in detail on the basis of the embodiments, but the embodiments disclosed in the present specification are just examples in all aspects of the invention and the invention is not limited to this disclosed technique. That is, the technical scope of the invention is not limited to the description of the embodiments, should be analyzed in accordance with description of claims in every point, and includes all possible modification in claims and techniques that are equal level to the technique described in claims.

For example, in the embodiment, the case where the regulating units S regulate the toner cartridges 13 (13Y, 13M, 13C, and 13K) for containing the toner serving as a visualizing agent so as not to depart from the cartridge holder is described, but the invention is not limited to this. Therefore, for example, ink may be used as a visualizing agent in inkjet printers and the like, and the cartridge may be regulated so as not to depart from the holding unit at the time of transportation of the printer, by engaging the regulating units S with the cartridges for containing the ink.

In addition, the regulating units S may be provided in the packing member for packing the printer body 1 at the time of transporting the printer. However, in this case, there is need to pack the printer in a state where the openable cover 100 is opened in order to expose the cartridge holder 41.

The image forming apparatus according to the invention is applicable to a laser printer, a full-color printer, an inkjet printer, a facsimile, and the like.

What is claimed is:

1. An image forming apparatus comprising:

a container that contains a visualizing agent consumed with an operation of forming a visual image on a recording medium;

a holding unit that holds the container at a first position in the holding unit and at a second position in the holding unit;

a cover member that openably covers the container and the holding unit; and a regulating unit provided in the cover member that engages with a part of the container at the first position and engages with the part of the container at the second position and maintains a disposition of the container in the holding unit at the first position and at the second position.

2. The image forming apparatus according to claim 1, wherein the regulating unit is a convex shaped portion formed on a face of the cover member.

3. The image forming apparatus according to claim 1, wherein the container comprises a shutter member that regulates flow of the visualizing agent into an interior portion of the image forming apparatus, and a manipulating member that interlocks with the shutter member, and wherein the regulating unit engages with a part of the manipulating member so as to prevent the manipulating member from displacing and to maintain the disposition of the container in the holding unit.

4. The image forming apparatus according to claim 3, wherein at the first position the manipulating member causes the shutter member to close and at the second position the manipulating member causes the shutter member to open, and the regulating unit engages with the manipulating member so as to maintain the first position or the second position.

5. The image forming apparatus according to claim 1, wherein the container further comprises:

a stirring and conveying member that stirs and conveys the visualizing agent; and a driving gear that detachably engages with a driving source included in the image forming apparatus that drives the stirring and conveying member, and wherein the regulating unit maintains the disposition of the container such that the driving gear in a state where the driving gear is separated from the driving source.

6. The image forming apparatus according to claim 1, wherein the container comprises:

a communicating unit that is detachably connected to a connecting unit of the image forming apparatus and that transmits information on the visualizing agent to the image forming apparatus itself, and wherein the regulating unit maintains a disposition of the container such that the communicating unit is distanced from the connecting unit.

7. The image forming apparatus according to claim 1, wherein the visualizing agent comprises at least one of a toner or an ink.

8. A cover member that covers a container and a holding unit of an image forming apparatus, the container containing a visualizing agent consumed with an operation of forming a visual image on a recording medium, the holding unit that holds the container at a first position in the holding unit and at a second position in the holding unit, the cover member comprising:

a regulating member that engages with a part of the container at the first position and the part of the container at the second position and maintains an orientation of the container in the holding unit at the first position and at the second position.

9. The regulating member according to claim 8, wherein the regulating member is a convex shaped portion formed on a face of the cover member.

10. A container that contains a visualizing agent consumed with an operation an image forming apparatus forming a visual image on a recording medium, the image forming apparatus including a holding unit that holds the container at a first position in the holding unit and at a second position in the holding unit, a cover member that openably covers the container and the holding unit, and a regulating member provided in the cover member that engages with a part of the container at the first position and the part of the container at the second position and maintains an orientation of the container in the holding unit at the first position and at the second position, the container comprising:

a handle that engages the regulating member at a first end of the handle at the first position and that engages the regulating member at a second end, opposite the first end, of the handle at the second position to maintain the orientation of the container in the holding unit at the first position and at the second position.

11. The container according to claim 10, further comprising:

a shutter member that regulates flow of the visualizing agent.

12. The container according to claim 10, wherein at the first position the shutter member is closed and at the second state the shutter member is opened, and the handle is formed so as to maintain the first state or the second state.

13. The container according to claim 10, further comprising:

a stirring and conveying member that stirs and conveys the visualizing agent; and a driving gear that detachably engages with a driving source included in the image forming apparatus that drives the stirring and conveying member, wherein the handle is formed so as to maintain a state where the driving gear is separated from the driving source.

14. The container according to claim 10, further comprising:

a communicating unit that is detachably connected to a connecting unit of the image forming apparatus and transmits information on the visualizing agent to an image processing apparatus, wherein the handle maintains a state where the communicating unit is distanced from the connecting unit.

15. The container according to claim 10, wherein the visualizing agent comprises at least one of a toner or an ink.

* * * * *